US008929787B2

(12) United States Patent
Ishimori

(10) Patent No.: US 8,929,787 B2
(45) Date of Patent: Jan. 6, 2015

(54) FIXING DEVICE AND IMAGE FORMING APPARATUS

(71) Applicant: Oki Data Corporation, Tokyo (JP)

(72) Inventor: Keita Ishimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/826,222

(22) Filed: Mar. 14, 2013

(65) Prior Publication Data

US 2013/0251417 A1 Sep. 26, 2013

(30) Foreign Application Priority Data

Mar. 23, 2012 (JP) ..... 2012-068355

(51) Int. Cl.
*G03G 15/20* (2006.01)

(52) U.S. Cl.
CPC ..... *G03G 15/2028* (2013.01)
USPC ..... 399/323; 399/320

(58) Field of Classification Search
USPC ..... 399/323
See application file for complete search history.

(56) References Cited

U.S. PATENT DOCUMENTS

2007/0166083 A1 * 7/2007 Satoh et al. ..... 399/323

FOREIGN PATENT DOCUMENTS

| | | | | |
|---|---|---|---|---|
| JP | S62-125256 U | | 8/1987 | |
| JP | 63098683 A | * | 4/1988 | ..... G03G 15/20 |
| JP | 2003-215967 A | | 7/2003 | |
| JP | 2006-154560 A | | 6/2006 | |
| JP | 2009-175538 A | | 8/2009 | |

* cited by examiner

*Primary Examiner* — Clayton E Laballe
*Assistant Examiner* — Jas Sanghera
(74) *Attorney, Agent, or Firm* — Panitch Schwarze Belisario & Nadel LLP

(57) ABSTRACT

A fixing device includes a heating member, a pressure member forming a nip portion with the heating member; and a separation member disposed on a downstream side of the nip portion in a medium conveyance direction, wherein the separation member includes a guide portion having a guide surface for guiding the recording medium to be conveyed, and a condensation portion formed at a position remote from the guide surface, to promote generation of water droplets due to condensation at the condensation portion and to prevent recording failures from occurring due to condensation by evaporating the generated water droplets at the condensation portion.

24 Claims, 6 Drawing Sheets

(a)

(b)

FIXING DEVICE AND IMAGE FORMING APPARATUS

CROSS REFERENCE TO RELATED APPLICATION

This application claims priority benefits under 35 USC, section 119 on the basis of Japanese Patent Application No. 2012-068355, the disclosure of which is incorporated herein by reference.

BACKGROUND OF THE INVENTION

1. Field of the Invention

This invention relates to a fixing device for fixing toner images transferred onto a recording medium to the recording medium with application of heat and pressure and relates to an image forming apparatus having the fixing device.

2. Description of Related Art

In a conventional image forming apparatus such as an electrophotographic recording apparatus, while developer images or toner images transferred to a recording medium are fixed to the recording medium in application of heat and pressure by a fixing device, a separation member is provided to surely separate the post-fixing recording medium from the fixing device, thereby peeling the recording medium from the fixing device (see, e.g., Japanese Patent Application Publication No. 2009-175538).

With this type of the image forming apparatuses, condensation may occur at the separation member, but the conventional art described above may not have any adequate countermeasure against condensation occurring at the separation member, so that there raises a problem to bring unwanted deformations and deteriorations on a side of the post-fixing recording medium and images due to such condensation. It is therefore an object of the invention to provide a solution for such a problem.

SUMMARY OF THE INVENTION

Therefore, the fixing device according to the invention includes a heating member, a pressure member forming a nip portion with the heating member; and a separation member disposed on a downstream side of the nip portion in a medium conveyance direction, wherein the separation member includes a guide portion having a guide surface for guiding the recording medium to be conveyed, and a condensation portion formed at a position remote from the guide surface.

The invention thus formed has an advantageous effect to prevent deformations and deteriorations on the recording medium and image from occurring due to condensation after fixed, because such generation of droplets due to condensation is likely prompted to take place at the condensation portion formed at the remote position from the guide surface of the separation member, thereby evaporating the generated droplets at the condensation portion.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF EMBODIMENTS

Figure 1:
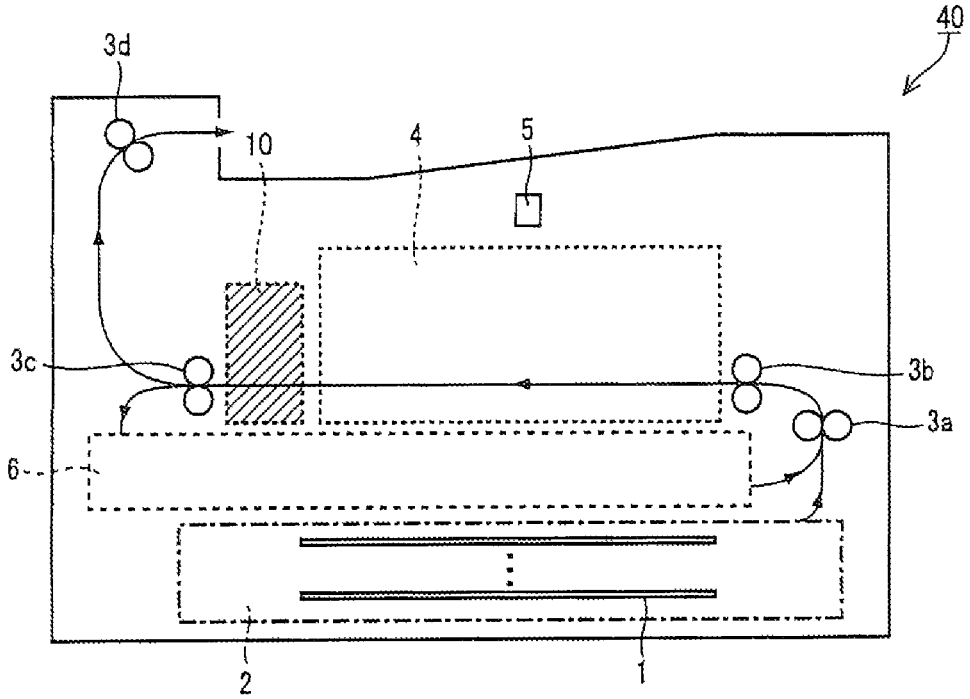
FIG. 1 is a schematic side view showing an internal structure according to a first embodiment of the invention.

Referring to the drawings, embodiments of a fixing device and an image forming apparatus according to the invention are described.

First Embodiment

Figure 2:
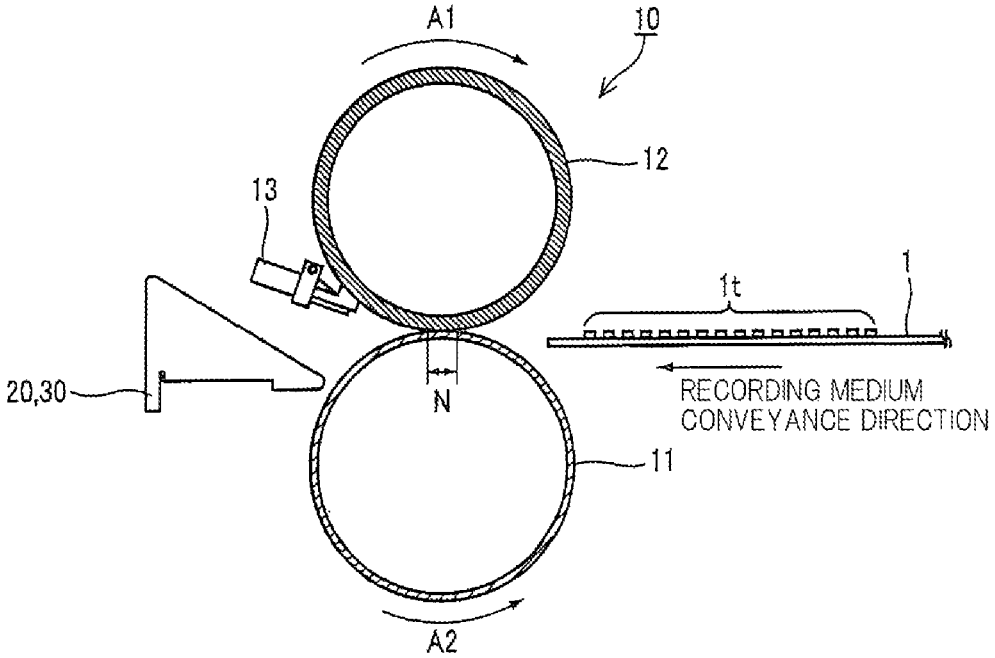
FIG. 2 is a side view showing a structural example of the fixing device according to the first embodiment.

FIG. 1 is a schematic side view showing an internal structure according to a first embodiment, and FIG. 2 is a side view showing a structural example of the fixing device 10. In these drawings, the reference number 40 indicates an image forming apparatus, and shows an electrophotographic printer as an example. This image forming apparatus 40 includes a recording controller, not shown, for controlling an internal mechanism. A recording medium cassette 2 for containing recording media 1 such as paper is detachably attached at a lower portion in the image forming apparatus 40. While the recording medium cassette 2 is located at the most upstream end in a medium conveyance direction, plural recording medium conveyance portions 3*a*, 3*b*, 3*c*, 3*d* made of conveyance roller pairs for conveying the recording medium 1 are arranged orderly from a delivery side of the recording medium 1 in the recording medium cassette 2 to a downstream end located over the image forming apparatus 40.

A developer image forming unit 4 for forming images 1*t* with a developer such as, e.g., toner, and a fixing device 10, are provided between the recording medium conveyance portions 3*b*, 3*c* in the order of conveyance of the recording medium 1, so that the developer image forming unit 4 is located on an upstream side whereas the fixing device 10 is located on the downstream side. A light emitting diode head (hereinafter referred to as "LED head") 5 serving as an exposing device for recording is arranged adjacently to the developer image forming unit 4.

The developer image forming unit 4 forms images on a photosensitive body by recording light emitted from the LED head 5, forms developer images 1*t* (see FIG. 2) by developing the images with the developer, and transfers the developer images 1*t* to the recording medium 1. The fixing device 10 disposed on a downstream side of the developer image forming unit 4 delivers the recording medium 1 toward the recording medium conveyance portion 3*d* on a downstream side after fixing the developer images 1*t* attached on the recording medium 1 with heat and pressure.

In a situation that recording is made on one side of the recording medium 1 as single side recording, the recording medium 1 is fed to the recording medium conveyance portion 3*d* as it is after the developer image 1*t* is fixed, and further to the exterior of the apparatus. To the contrary, in a situation of double side recording, the recording medium 1 is fed to a recording medium reversing unit 6. The side of the recording medium 1 is reversed by the recording medium reversing unit 6, and the recording medium 1 is fed to the recording medium conveyance portion 3*a*. After the developer image 1*t* is formed, the recording medium 1 is then fed to the recording medium conveyance portion 3*d* after subjecting to the process of fixing, and is ejected to the exterior of the apparatus.

As shown in FIG. 2, the fixing device 10 according to this embodiment is made of a fixing roller 12 for supplying heat to the recording medium 1, a press roller 11 for pressing the recording medium 1, and separation members 13, 20 for separating the recording medium 1 from the press roller 11 and the fixing roller 12, and the press roller 11 and the fixing roller 12 are provided in pressurized contact with each other. The fixing roller 12 may be formed of, e.g., a roller, a pressing pad, and a belt, or a combination of those, and also the press roller 11 may be formed of, e.g., a roller, a pressing pad, and a belt, or a combination of those.

Some heating member such as, e.g., a halogen heater is provided at the fixing roller 12 and the press roller 11 for increasing the temperature of the roller surface, and a temperature detecting means, not shown, detects the temperature to maintain a certain temperature with the recording controller, not shown. Each temperature detecting means in this mechanism may be provided as to contact an outer or inner peripheral surface of the fixing roller 12 and the press roller 11 or be provided as to be in non-contact with those surfaces with a very small gap.

As a detailed description of the press roller 11 and the fixing roller 12, the press roller 11 has a center shaft supported in a rotational manner via a bearing to a frame not shown, and is pushed to the fixing roller 12 by an elastic body such as, e.g., a spring. The fixing roller 12 has a center shaft supported in a rotational manner via a bearing to a frame not shown, in the same manner as the press roller 11, and the center shaft of the fixing roller 12 is formed with a gear or gears, not shown. Transmission of rotational force from the recording medium conveyance portion 3*c* to the gear makes the fixing roller 12 driven to rotate in arrow A1 direction, so that the press roller 11 is driven by the fixing roller 12 and rotates in arrow A2 direction because the press roller 11 receives frictional force from the surface of the fixing roller 12 at the surface thereof. Alternatively, the rotational force from the recording medium conveyance portion 3*c* may be transmitted to the press roller 11 as to make the fixing roller 12 driven to rotate.

The press roller 11 and the fixing roller 12 have a core metal made of such as, e.g., aluminum, iron, etc., an elastic body layer such as, e.g., fluoride rubber, silicone rubber, etc., and a surface releasing layer made of a fluoride based resin. Those materials generate a nip portion N at the pressurized contact area between the fixing roller 12 and the press roller 11 in a range of the pressurized contact, and the recording medium 1 is sandwiched to be conveyed at the nip portion N.

Regarding the separation members 13, 20, the separation member 13 is disposed on a downstream side of the nip portion N in the medium conveyance direction, and is arranged as to render a leading edge portion thereof located adjacently to the fixing roller 12. The separation member 13 serves for guiding the recording medium 1 to be conveyed to the recording medium conveyance portion 3*c* located on a downstream side of the fixing roller 12 in the medium conveyance direction. The separation member 20 separates, from the press roller 11, the recording medium 1 mainly passing through the nip portion N in the same manner as the separation member 13, and guides the recording medium 1 to be conveyed to the recording medium conveyance portion 3*c* located on the downstream side of the press roller 11.

As such the separation member 13, used is a combination of a metal member made of a high heat conductive, high corrosion resistance metal such as aluminum, copper, stainless steel, etc., and an improved heat resistance resin member made of PET (polyethylene terephthalate) or the like filled with glass fibers. As such the separation member 20, used is a resin member integrally formed of an improved heat resistance resin made of PET (polyethylene terephthalate) or the like filled with glass fibers.

Figure 3:
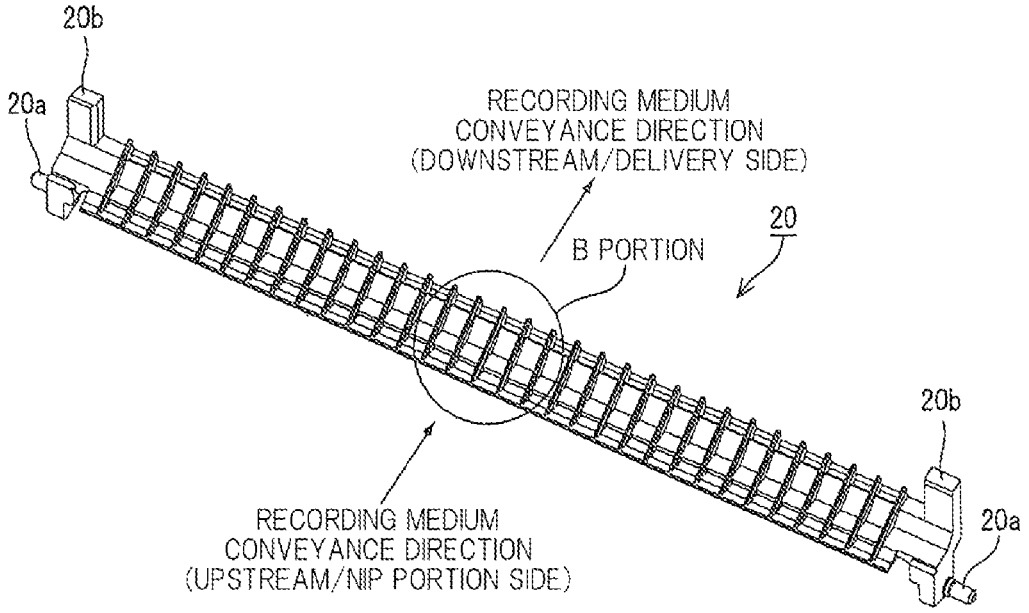
FIG. 3 is a perspective view showing a separation member according to the first embodiment.

FIG. 3 is a perspective view showing the separation member 20 according to this embodiment. The separation member 20 is pivotally supported by such as a frame, not shown, with a projecting portion 20*a* formed at each end thereof serving as a pivotal support. The separation member 20 is urged as to render a leading edge thereof come closer to the side of the press roller 11 by a spring such as, e.g., a torsion spring, not shown, attached to the projecting portion 20*a*, and a stopper 20*b* is formed at each end so as to form a certain gap between the leading edge and the press roller 11, thereby being in contact with the frame, not shown.

Figure 4:
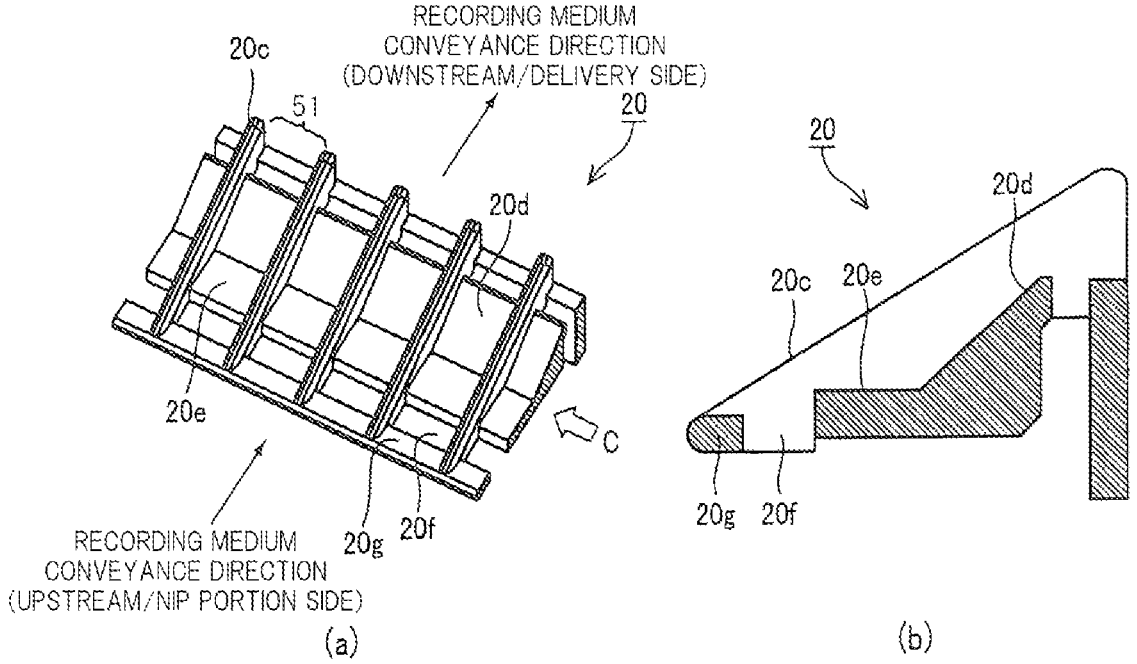
FIG. 4 is an enlarged view showing an essential portion of the separation member according to the first embodiment.

FIG. 4 is an enlarged view showing an essential portion of the separation member 20; FIG. 4(*a*) is an enlarged perspective view showing B section in FIG. 3; FIG. 4(*b*) is a cross section when seen in arrow C direction. As shown in FIG. 4(*a*), the separation member 20 is formed with plural ribs 20*c* extending parallel in the conveyance direction of the recording medium for guiding the recording medium serving as a guide portion in having a guide surface guiding the recording medium 1. Each rib 20*c* is formed as to be lower on an upstream side in the recording medium conveyance direction and as to be higher as more approaching the downstream side when seen in a vertical direction. That is, each rib 20*c* has a height lower on the side of the leading edge and higher on the side of the rear end of the separation member 20. The rib 20*c* is formed over the whole separation member 20 in the lengthwise direction.

A condensation portion 51 is provided between the ribs 20*c* adjacent to each other, and the condensation portion 51 is formed to be lower than the height of the rib 20*c*. That is, when seen from the recording medium 1 to be conveyed, the condensation portion 51 is formed at a position remote from the guide surface of the rib 20*c*. The condensation portion 51 is structured of a slant surface 20*d* formed in a slant manner to be higher as coming closer from the upstream side to the downstream side so as to face the recording medium in a manner extending in the medium conveyance direction in serving as a first surface portion for promoting condensation, and a plane portion 20*e* serving as a second surface portion formed on a downstream side of the slant surface 20*d*. Formation such that both of the slant surface 20*d* and the plane portion 20*e* are formed at positions lower than the height of the ribs 20*c* for guiding the recording medium, makes the condensation portion not in contact with the recording medium 1. The width of the condensation portion 51 formed of the slant surface 20*d* and the plane portion 20*e* is formed larger than a width of the rib 20*c* in a direction perpendicular to the medium conveyance direction.

An opening 20*f* is formed between the plane portion 20*e* of the condensation portion 51 and a leading edge 20*g* of the separation member 20; the leading edge 20*g* of the separation member 20 is formed integrally with the upstream end of each rib 20*c* for separating the recording medium 1 from the press roller 11; the whole length of the leading edge 20*g* is longer than the length of the side extending perpendicular to the conveyance direction of the recording medium 1.

Operations done at respective portions to be described below are controlled by a recording controller, not shown, based on control programs stored in a memory or other memorizing devices, not shown. In operation for fixing, where the fixing roller 12 in the fixing device 10 rotates in arrow A1 direction shown in FIG. 2 during recording operation, the press roller 11 rotates in arrow A2 direction as contacting in a sliding manner with the fixing roller 12 at the nip portion N. The fixing roller 12 at that time is heated by a heating means in a state generating heat upon already supplied with electric power. A temperature detecting means, not shown, detects the surface temperature of the fixing roller 12, and based on this detection, the recording controller controls supplying electric power to the heating means to maintain the surface of the fixing roller 12 at a proper temperature.

When the recording medium 1 to which a developer image 1*t* is transferred is conveyed to the fixing device 10, the recording medium 1 goes by the nip portion N as a pressed point between the fixing roller 12 and the press roller 11. The developer image 1*t* on the recording medium 1 is heated and pressed by the fixing roller 12 and the press roller 11 during passage at the nip portion N, thereby fixing the developer image 1*t* on the recording medium 1. The recording medium 1 passing the nip portion N is separated from the press roller 11 and the fixing roller 12 by the separation members 13, 20, and is ejected from the fixing device 10.

Condensation may occur at the separation member 20 at a time that the recording member 1 passes the nip portion N. That is, when the recording medium 1 passes the nip portion N, heat given to the recording medium 1 for fixing the developer image 1*t* makes moisture contained in the recording medium 1 evaporated to be water vapor, which is exhausted from the nip portion N, thereby rendering rich the moisture amount in atmosphere near the nip portion N. Condensation unlikely occurs in a high temperature state in the separation member 20, but condensation likely occurs at the separation member 20 where the separation member 20 is in a low temperature state, because the moisture amount in the atmosphere near the nip portion N exceeds the saturated water vapor amount in the atmosphere where the atmosphere temperature is low around the separation member 20.

Figure 5:
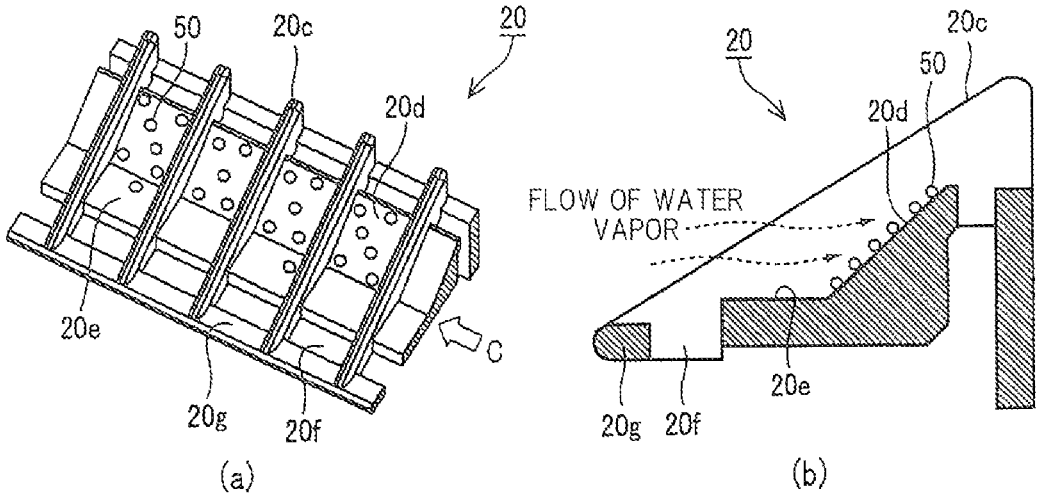
FIG. 5 is an enlarged view showing occurrences of condensation at the essential portion of the separation member in the first embodiment.

FIG. 5 is an enlarged view of an essential portion of the separation member 10 showing occurrences of condensation; FIG. 5(*a*) is an enlarged perspective view; FIG. 5(*b*) is a cross section when seen in arrow C direction. A large amount of water vapor generated concurrently as the recording medium 1 passes the nip portion N flows in the same direction as the conveyance direction of the recording medium 1. Such a large amount of water vapor blows or impacts a wide area of the slant surface 20*d* inclined as to face the conveyance direction, so that the slant surface 20*d* promotes generation of many droplets 50 caused from condensation as shown in FIG. 5(*a*), 5(*b*), thereby suppressing generation of condensation at the rib 20*c* for guiding the recording medium and at the leading edge 20*g* for separation of the recording medium.

A guide surface, or top surface, of the rib 20*c* for guiding the recording medium reduces contact between the guide surface and the recording medium 1 by forming a curving surface in a convex shape in a direction perpendicular to the conveyance direction of the recording medium 1, thereby not readily generating condensation. The leading edge 20*g* for separation of the recording medium is easily affected by heat radiation from the press roller 11 and the fixing roller 12 because the leading edge 20*g* is located adjacently to the press roller 11, so that the leading edge 20*g* can be readily subject to temperature increase in comparison with other portions. In addition, because the leading edge 20*g* has the opening 20*f* between the plain surface 20*e* and the leading edge 20*g*, heat stored in the leading edge 20*g* not readily escapes to other portions, thereby causing acceleration of temperature increase.

Figure 6:
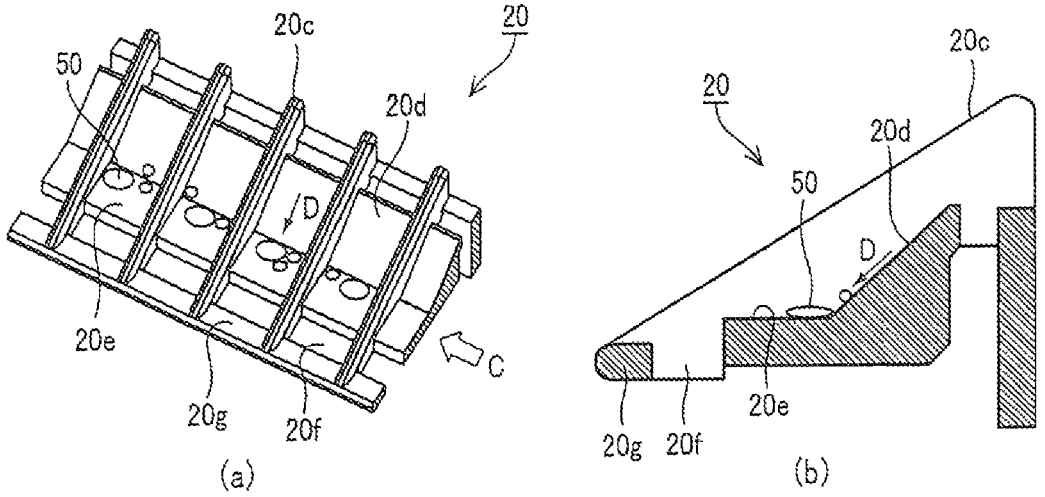
FIG. 6 is an enlarged view showing a state immediately after the occurrences of condensation at the essential portion of the separation member in the first embodiment.

FIG. 6 is an enlarged view of an essential portion of the separation member 10 showing a state immediately after occurrences of condensation; FIG. 6(*a*) is an enlarged perspective view; FIG. 6(*b*) is a cross section when seen in arrow C direction. As described above, a slant surface 20*d* is disposed as to be a lower position on the upstream side and a higher position on the downstream side in the medium conveyance direction. Water droplets 50 generated at the slant surface 20*d* due to condensation consequently flow down in arrow D direction along the slant surface 20*d* as shown in FIG. 6(*a*), 6(*b*), and move to and are held to the plane surface 20*e* located near the nip portion N, thereby evaporating the water droplets 50 at the plane surface 20*e*. Because the temperature more increases as coming closer to the nip portion N, the device is able to effectively evaporate the water droplets 50 due to condensation. Accordingly, the water droplets 50 due to condensation unlikely remain in a large amount at the slant surface 20*d*, and the slant surface 20*d* may promote again generation of water droplets 50 due to condensation.

Because the opening 20*f* is formed between the plane surface 20*e* and the leading edge 20*g*, the water droplets 50 flow down from the opening 20*f* even where the water droplets 50 at the plane surface 20*e* increases its amount and flow toward the leading edge direction, so that the water droplets 50 may not be attached to the leading edge 20*g*. According to the operation described above, droplets 50 can be prevented from occurring due to condensation at the rib 20*c* for guiding recording medium and at the leading edge 20*g* for separating the recording medium by effectively reducing moisture in the atmosphere upon effectively promoting generation of water droplets 50 on the slant surface 20*d* due to condensation.

In the first embodiment, as described above, this fixing device can prevent condensation from occurring at the rib 20*c* for guiding recording medium to which the recording medium 1 contacts and at the leading edge 20*g* for separating the recording medium, by generating condensation at the slant surface 20*d* of the separation member 20 with the water vapor coming out of the recording medium 1 generated during the fixing operation. The droplets 50 occurring due to condensation at the slant surface 20*d* flow down along the slant surface 20*d* and move to the plane surface 20*e*, so that the device can promote occurrences of condensation again. The guide surface of the rib 20*c* for guiding recording medium is made in a curving shape to reduce contact with the recording medium 1, and is made in a shape not easily attaching water droplets 50 occurring due to condensation, so that water droplets 50 are prevented from occurring due to condensation by increasing the temperature in a priority manner where the leading edge 20*g* for separating the recording medium suppresses heat leakage with the opening 20*f* provided between the leading edge and the plane surface 20*e*. This fixing device 10 therefore has an advantage to prevent the recording medium 1 or developer images 1*t* from deteriorating in shapes and qualities otherwise occurring from causes of attachments of water droplets 50 due to condensation to the separation member 20 of the fixing device 10.

Second Embodiment

A second embodiment is described next. The structure of the image forming apparatus according to the second embodiment is substantially the same as that of the first embodiment except use of a separation member 30 in lieu of the separation member 20 in the first embodiment, so that a duplicated description is omitted.

Figure 7:
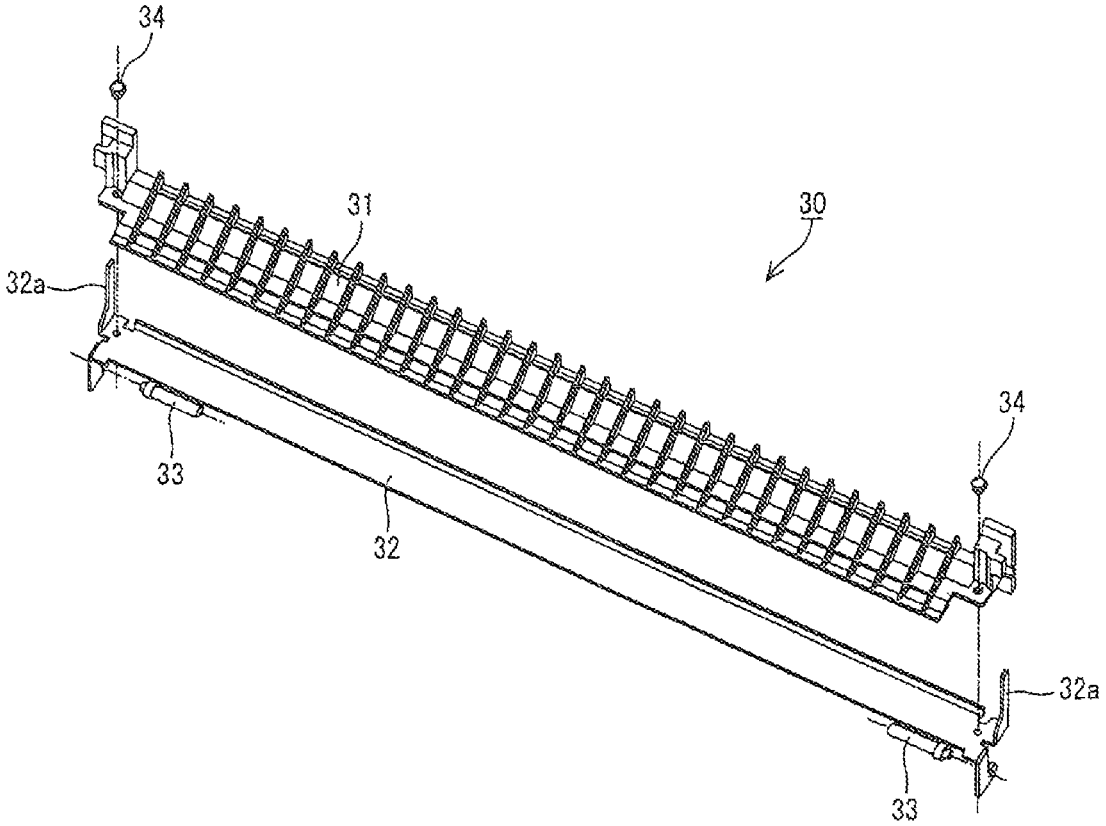
FIG. 7 is a perspective view showing a separation member prior to assembling according to a second embodiment.
Figure 8:
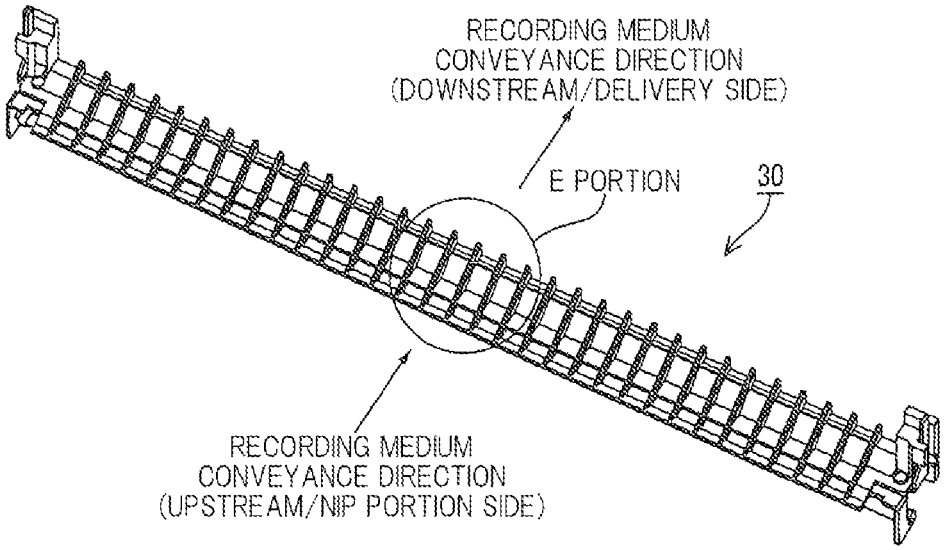
FIG. 8 is a perspective view showing the separation member after assembling according to the second embodiment.

FIG. 7 is a perspective view showing the separation member 30 prior to assembling according to the second embodiment; FIG. 8 is a perspective view showing the separation member 30 after assembling according to the second embodiment. The separation member 30 according to this embodiment includes a metal member 32 made of a high heat conductive, high corrosion resistance metal such as aluminum, copper, stainless steel, etc. or an alloy having main components of those, and a resin member 31 with improved heat resistance made of PET (polyethylene terephthalate) or the like filled with glass fibers. The separation member 30 has the metal member 32 contacting a lower surface of the resin member 31, and a screw 34 secures the member 30 by penetrating each end of the members 31, 32 from the side of the resin member 31.

A post 33 is secured at each end of the metal member 32 in a caulking manner or the like. The post 33 is attached to a frame, not shown, and the separation member 30 is pivotally movable around the post 33 as a pivotal center. A spring such as a torsion spring, not shown, is attached to the post 33, and this spring urges the leading edge of the separation member 30 to come closer toward the press roller 11 as shown in FIG. 2. A stopper portion 32*a* formed at each end of the metal member 32 is in contact with the frame portion, not shown, as to ensure a certain space between the leading edge and the press roller 11.

Figure 9:
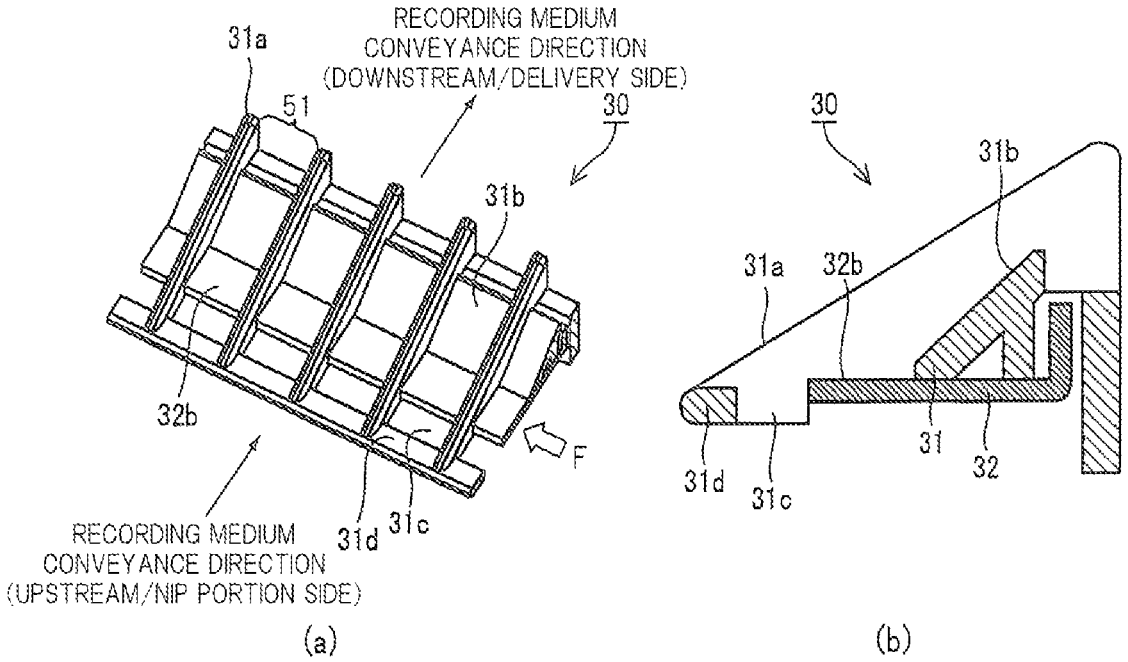
FIG. 9 is an enlarged view showing an essential portion of the separation member in FIG. 8.

FIG. 9 is an enlarged view showing an essential portion of the separation member 30; FIG. 9(*a*) is an enlarged perspective view showing E portion in FIG. 8; FIG. 9(*b*) is a cross section when seen in arrow F direction. As shown in FIG. 9(*a*), the resin member 31 is formed with plural ribs 31*a* extending parallel for guiding the recording medium serving as a guide portion having a guide surface guiding the recording medium 1, and each rib 31*a* is formed to have a higher height as approaching further the downstream side. That is, each rib 31*a* is formed to have a height low on the leading edge side and high on the rear end side of the separation member 30. It is to be noted that the ribs 31*a* are provided over the entire length in a longitudinal direction of the separation member 30.

A condensation portion 51 is provided between the ribs 31*a* adjacent to each other, and the condensation portion 51 is formed lower than the height of the rib 31*a*. The condensation portion 51 is structured of a slant surface 31*b* serving as a first surface portion for promoting condensation in facing the conveyance direction of the recording medium 1 by so inclining the surface as to be higher as approaching from the upstream side to the downstream side, and a plane surface 32*b* serving as a second surface portion located on a lower end side of the slant surface 31*b*. The plane surface 32*b* is a front side portion of the metal member 32 contacting to a lower surface of the resin member 31, and is a portion of the metal member 32 exposed from the resin member 31. That is, in this embodiment, the metal member 32 is in contact with the lower portion of the slant surface 31*b* of the resin member 31, and a part of the member is exposed from the resin member 31. The metal member 32 is bent in a letter-L shape to gain rigidity.

The slant surface 31*b* and the plane surface 32*b* are made not contacting to the recording medium 1 by forming the slant surface 31*b* and the plane surface 32*b* at lower respective positions than the height of the ribs 31*a* for guiding the recording medium. The width of the condensation portion 51 made of the slant surface 31*b* and the plane surface 32*b* is formed larger than the width of the rib 31*a* in a direction perpendicular to the medium conveyance direction. An opening 31*c* is formed between the plane surface 32*b* of the condensation portion 51 and the leading edge 31*d* of the separation member 30. The leading edge 31*d* of the separation member 30 is a portion for separating the recording medium 1 from the press roller 11 and is formed in a united body with an end of the respective ribs 31*a* on the upstream side. The whole length of the leading edge 31*d* is longer than the length of the edge of the recording medium 1 in a direction perpendicular to the conveyance direction.

Operation of the structure thus formed is described. Operations of the respective units in the second embodiment are also controlled by a recording controller not shown based on a control program stored in a memory not shown in substantially the same way as in the first embodiment. Because the fixing operation in the second embodiment is substantially the same as that in the first embodiment, a duplicated description is omitted.

Figure 10:
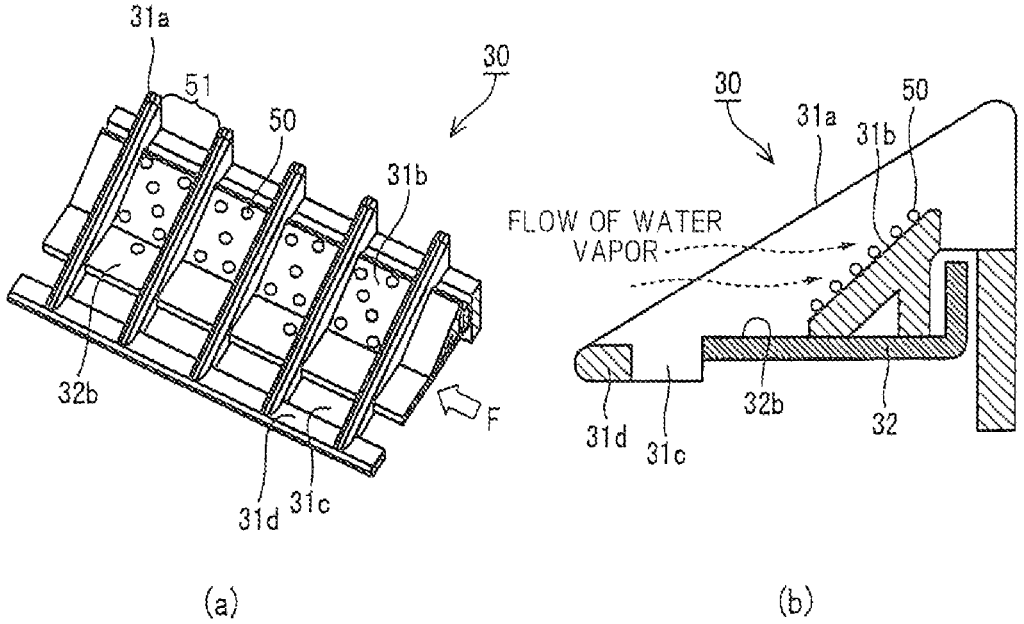
FIG. 10 is an enlarged view showing occurrences of condensation at the essential portion of the separation member in the second embodiment.

In this embodiment, condensation may occur at the separation member 30 in substantially the same way as in the first embodiment at a time that the recording medium 1 pass the nip portion N as a pressurized contact point between the fixing roller 12 and the press roller 11. FIG. 10 is an enlarged view showing occurrences of condensation at an essential portion of the separation member 30; FIG. 10(*a*) is an enlarged perspective view; FIG. 10(*b*) is a cross section when seen in arrow F direction in FIG. 10(*b*). A large amount of water vapor occurring concurrently when the recording medium 1 passes the nip portion N flows in the same direction as the conveyance direction of the recording medium 1 as shown in FIG. 10(*b*). Most of the water vapor blows into a wide area of the slant surface 31*b* arranged in a slant manner as to face the conveyance direction, so that the slant surface 31*b* promotes generation of many water droplets 50 due to condensation as shown in FIG. 10(*a*) and FIG. 10(*b*), thereby suppressing generation of condensation at the ribs 31*a* for guiding the recording medium and the leading edge 31*d* for separating the recording medium.

A guide surface, or top surface, of the rib 31*a* for guiding the recording medium reduces contact between the guide surface and the recording medium 1 by forming a curving surface in a convex shape in a direction perpendicular to the conveyance direction of the recording medium 1, thereby not readily generating condensation. The leading edge 31*d* for separation of the recording medium is easily affected by heat radiation from the press roller 11 and the fixing roller 12 because the leading edge 31*d* is located adjacently to the press roller 11, so that the leading edge 31*d* can be readily subject to temperature increase in comparison with other portions. In addition, because the leading edge 31*d* has the opening 31*c* between the exposing plain surface 32*b* of the metal member 32 and the leading edge 31*d*, heat stored in the leading edge 31*d* not readily escapes to other portions, thereby causing acceleration of temperature increase.

Figure 11:
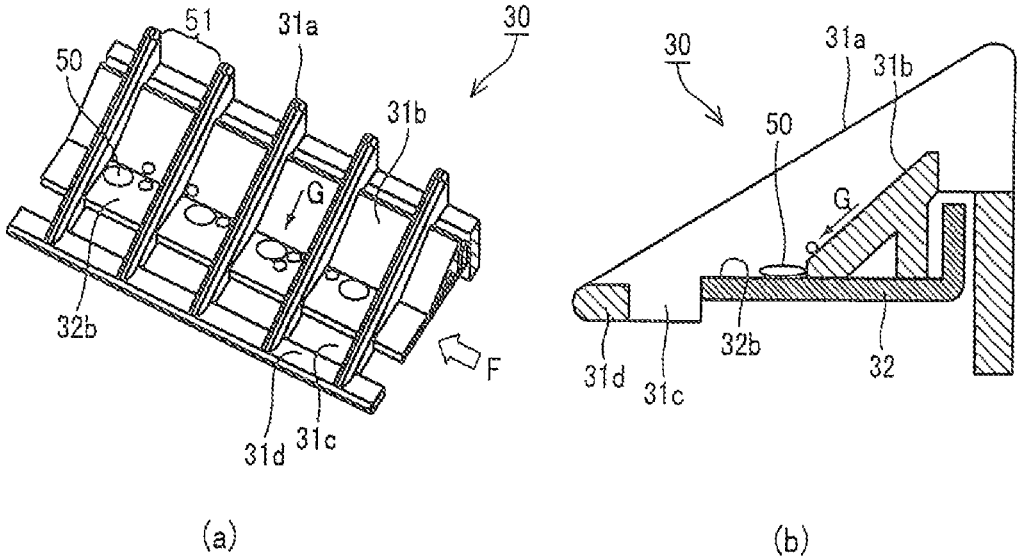
FIG. 11 is an enlarged view showing a state immediately after the occurrences of condensation at the essential portion of the separation member in the second embodiment.

FIG. 11 is an enlarged view of an essential portion of the separation member 30 showing a state immediately after occurrences of condensation; FIG. 11(*a*) is an enlarged perspective view; FIG. 11(*b*) is a cross section when seen in arrow F direction. As described above, a slant surface 31*b* is disposed as to be a lower position on the upstream side and a higher position on the downstream side in the medium conveyance direction. Water droplets 50 generated at the slant surface 31*b* due to condensation consequently flow down in arrow G direction along the slant surface 31*b* as shown in FIG. 11(*a*), 11(*b*), and move to and are held to the exposing plane surface 32*b* of the metal member 32 located near the nip portion N, thereby evaporating the water droplets 50 at the plane surface 32*b*. Because the temperature more increases as coming closer to the nip portion N, the device is able to effectively evaporate the water droplets 50 due to condensation. Accordingly, the water droplets 50 due to condensation unlikely remain in a large amount at the slant surface 31*b*, and the slant surface 31*b* may promote again generation of water droplets 50 due to condensation. Furthermore, the exposing plane surface 32*b* of the metal member 32 has a higher heat conductance than the resin member 31, so that droplets 50 are readily evaporated, and consequently, the water droplets 50 due to condensation flow from the slant surface 31*b* with higher efficiency, thereby readily promoting generation of condensation at the slant surface 31*b*.

Because the opening 31*c* is formed between the plane surface 32*b* and the leading edge 31*d*, the water droplets 50 flow down from the opening 31*c* even where the water droplets 50 at the plane surface 32*b* increases its amount and flow toward the leading edge direction, so that the water droplets 50 may not be attached to the leading edge 31*d*. According to the operation described above, droplets 50 can be prevented from occurring due to condensation at the rib 31*a* for guiding recording medium and at the leading edge 31*d* for separating the recording medium by effectively reducing moisture in the atmosphere upon effectively promoting generation of water droplets 50 on the slant surface 31*b* due to condensation.

As described above, in the second embodiment, the fixing device has an advantage to increase the efficiency for promoting generation of condensation on the slant surface 31*b* of the separation member 30 due to water vapor in the recording medium occurring during the fixing operation. The combination of the metal member 32 and the resin member 31 brings reduction of the total heat amount of the resin member 31 contacting the recording medium 1, thereby bringing an advantage to increase the temperature of the separation member 30 up to a temperature not generating condensation in a short period.

This invention is not limited to the embodiments described above but can be changed or modified in various ways as far as not deviated from the scope and spirit of the invention. Although in the first and second embodiments, exemplified are the electrophotographic printers serving as image forming apparatuses, this invention is not limited to those, and is applicable to facsimile machines, photocopiers, printers, MFPs, etc.

What is claimed is:

1. A fixing device comprising:

a heating member;

a pressure member forming a nip portion with the heating member; and a separation member disposed on a downstream side of the nip portion in a medium conveyance direction, wherein:

the separation member includes a guide portion having a guide surface for guiding a recording medium to be conveyed, and a condensation portion formed at a position remote from the guide surface, the guide portion is provided in a plural number in a direction perpendicular to the medium conveyance direction, the condensation portion is provided between the plural guide portions adjacent to each other, and the condensation portion has a larger width than a width of the guide portion in a direction perpendicular to the medium conveyance direction.

2. The fixing device according to claim 1, wherein the condensation portion is arranged at a position lower than a height of the guide surface.

3. The fixing device according to claim 1, wherein the guide portion is made of plural ribs whose guide surface for guiding the recording medium is a curving surface.

4. An image forming apparatus comprising the fixing device of claim 1 and a developer image forming unit.

5. The fixing device according to claim 1, wherein the condensation portion has a slant surface facing the medium conveyance direction.

6. The fixing device according to claim 5, wherein the slant surface is configured so as to be lower on an upstream side in the medium conveyance direction and higher on a downstream side in the medium conveyance direction.

7. The fixing device according to claim 1, wherein the condensation portion has a slant surface arranged at a position via an opening from a leading edge of the separation member for separating the recording medium.

8. The fixing device according to claim 1, wherein the condensation portion includes a slant surface and a plane portion arranged at a lower portion of the slant surface in a slanting direction.

9. The fixing device according to claim 8, wherein the separation member is made of a resin member and a metal member, the metal member includes an exposed metal plate forming the plane portion, and the metal plate is in contact with the lower portion of the slant surface.

10. The fixing device according to claim 1, further comprising a leading edge arranged at an upstream side of the separation member in the medium conveyance direction, the leading edge extending in a direction perpendicular to the medium conveyance direction, wherein the width of the leading edge is wider than the width of the condensation portion in a direction perpendicular to the medium conveyance direction.

11. A fixing device comprising:

a heating member;

a pressure member forming a nip portion with the heating member; and a separation member disposed on a downstream side of the nip portion in a medium conveyance direction, wherein:

the separation member includes a guide portion having a guide surface for guiding a recording medium to be conveyed, and a condensation portion formed at a position remote from the guide surface, and the condensation portion has a slant surface.

12. The fixing device according to claim 11, wherein the slant surface is formed so as to face the medium conveyance direction.

13. The fixing device according to claim 12, wherein the slant surface is configured so as to be lower on an upstream side in the medium conveyance direction and higher on a downstream side in the medium conveyance direction.

14. The fixing device according to claim 11, wherein the slant surface is arranged at a position via an opening from a leading edge of the separation member for separating the recording medium.

15. The fixing device according to claim 11, wherein the condensation portion includes a plane portion arranged at a lower portion of the slant surface in a slanting direction.

16. The fixing device according to claim 15, wherein the separation member is made of a resin member and a metal member, wherein the metal member includes an exposed metal plate forming the plane portion, and wherein the metal plate is in contact with the lower portion of the slant surface.

17. The fixing device according to claim 11, wherein the condensation portion is arranged at a position lower than a height of the guide surface.

18. The fixing device according to claim 11, wherein the guide portion is made of plural ribs whose guide surface for guiding the recording medium is a curving surface.

19. An image forming apparatus comprising the fixing device of claim 11, and a developer image forming unit.

20. The fixing device according to claim 1, further comprising a leading edge arranged at an upstream side of the separation member in the medium conveyance direction, the leading edge extending in a direction perpendicular to the medium conveyance direction, wherein the condensation portion has a slant surface, wherein the slant surface is formed at a position remote from the guide surface with respect to the recording medium to be conveyed, wherein the condensation portion further includes a plane portion extending from an edge of an upstream side in the medium conveyance direction of the slant surface, and wherein the guide surface and the leading edge are formed integrally with a resin member, and the plane portion is made of a metal member.

21. The fixing device according to claim 11 further comprising a leading edge arranged at an upstream side of the separation member in the medium conveyance direction, the leading edge extending in a direction perpendicular to the medium conveyance direction, wherein the slant surface is formed at a position remote from the guide surface with respect to the recording medium to be conveyed, wherein the condensation portion further includes a plane portion extending from an edge of an upstream side in the medium conveyance direction of the slant surface, and wherein the plane portion and the leading edge are formed integrally with a resin member.

22. The fixing device according to claim 20, wherein the leading edge is disposed such that a gap is provided between the leading edge and an upstream side of the plane portion in the medium conveyance direction.

23. The fixing device according to claim 21, wherein the leading edge is disposed such that a gap is provided between the leading edge and an upstream side of the plane portion in the medium conveyance direction.

24. The fixing device according to claim 11, further comprising a leading edge arranged at an upstream side of the separation member in the medium conveyance direction, the leading edge extending in a direction perpendicular to the medium conveyance direction, wherein the width of the leading edge is wider than the width of the condensation portion in a direction perpendicular to the medium conveyance direction.

* * * * *